United States Patent [19]

Van Gils

[11] 4,163,170

[45] Jul. 31, 1979

[54] LOW-PRESSURE GAS DISCHARGE LAMP

[75] Inventor: Wilhelmus M. J. Van Gils, Eindhoven, Netherlands

[73] Assignee: U.S. Philips Corporation, New York, N.Y.

[21] Appl. No.: 829,735

[22] Filed: Sep. 1, 1977

[30] Foreign Application Priority Data

Sep. 14, 1976 [NL] Netherlands ..... 7610169

[51] Int. Cl.[2] ..... H01J 61/06

[52] U.S. Cl. ..... 313/217; 313/332; 339/50 C

[58] Field of Search ..... 313/332, 217; 339/50 C

[56] References Cited

U.S. PATENT DOCUMENTS 3,795,887 3/1974 Higuchi ..... 339/50 C

*Primary Examiner*—Gerard R. Strecker
*Assistant Examiner*—Darwin R. Hostetter
*Attorney, Agent, or Firm*—Robert S. Smith

[57] ABSTRACT

A low-pressure gas discharge lamp having a curved lamp vessel and a lamp base construction being disposed intermediate the opposed spaced ends of the lamp vessel. Contact pins which are preferably tubular are disposed in the lamp base and are provided with electrically conducting extension pieces which are fastened cross-wise in a place outside the lamp base near the center line of the lamp vessel to the corresponding feedthrough wires of the electrodes.

1 Claim, 2 Drawing Figures

LOW-PRESSURE GAS DISCHARGE LAMP

Figure 1:
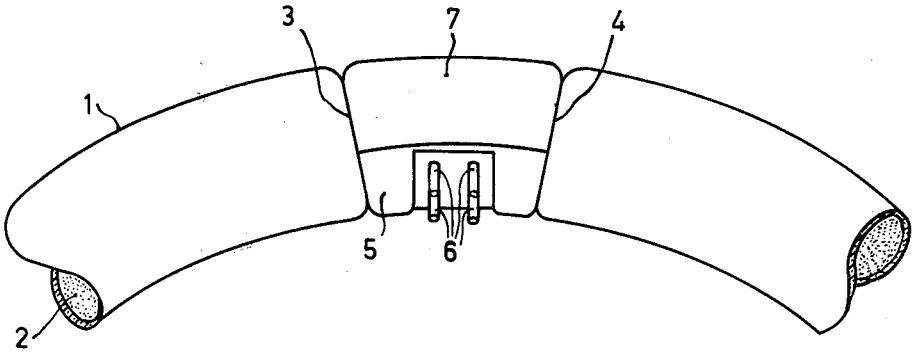

The invention relates to a low-pressure gas discharge lamp provided with a rectangular, curved lamp vessel, provided with electrodes, the ends of the lamp vessel which are bent towards each other comprising the feedthrough wires of the electrodes and which ends are arranged opposite to and spaced from one another and are accommodated in a common lamp base of electrically non-conducting material which is possibly provided with a cover cap, the lamp base being provided with contact pins and extending from these contact pins to not further than the centre line of the lamp vessel.

Such a lamp is disclosed in Swiss Patent No. 267,806.

During manufacture of the above-described lamp the feedthrough wires are connected to respective extension plates whereafter the contact pins which are in the form of rigid pins are connected end-on to the major surfaces of the extension plates. Only in a later stage of the manufacturing process the lamp base is clamped between the ends of the lamp vessel, the lamp base having openings through which the rigid pins are passed. During assembly of the lamp according to the Swiss patent specification, the position of the above-mentioned cross connection must be very precise and torsion of the rigid pins must be prevented. To this end the cover cap has been provided with special recesses which accommodate and locate the feedthrough wires and the extension plates. This requires a strong cross connection as damaging this connection during assembly of the lamp base is impossible.

The object of invention is to provide a lamp having a lamp base construction which obviates the above-mentioned drawbacks and which is easy to mechanize during the production.

A low-pressure gas discharge lamp of the type mentioned in the preamble is characterized in accordance with the invention in that the contact pins, which are preferably tubular, are provided with or part of electrically conducting filament extension pieces, each of the extension pieces being connected cross-wise in a place near the centre line of the lamp vessel outside the lamp base to the corresponding feedthrough wires.

During manufacture of a lamp according to the invention the lamp base is first clamped between the ends of the lamp vessel, so that the lamp base is fixed in place. Thereafter, the filament extension pieces which are already provided in the lamp base and which are fastened to the tubular contact pins, for example by means of a riveted joint, are fastened to the feedthrough wires in a place outside the lamp base, so that this mounting is not hindered by other objects. By using a cross-wise connection no special demands need be imposed on the fixation of the place of the joint. In addition, the cross-wise connecting of the extension pieces with the feedthrough wires has the advantage that intermediate plates are not necessary by making the diameter of the extension pieces and the feedthrough wires approximately equal. Thus the mounting of a lamp base construction according to the invention can be mechanized in a simple manner.

The invention will be further explained with reference to a drawing.

Figure 2:
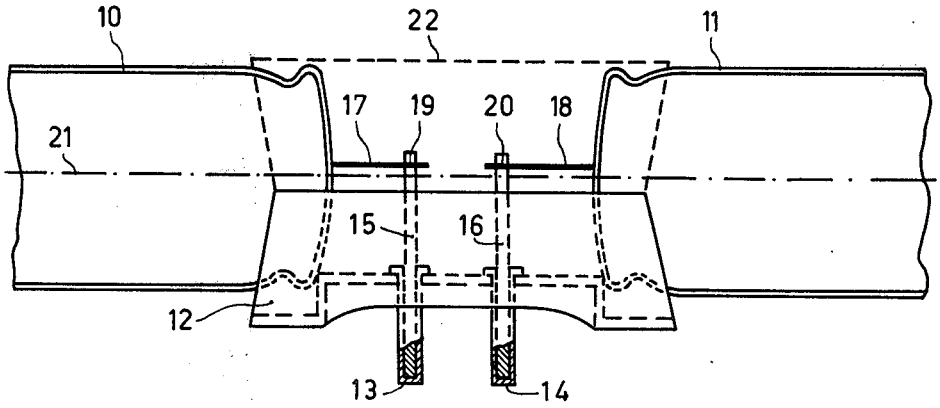

In the drawing FIG. 1 shows a portion of a curved lamp vessel of a low-pressure mercury vapour discharge lamp having a lamp base in accordance with the invention and FIG. 2 shows a longitudinal section of a lamp base construction according to the invention.

In FIG. 1 a portion of the curved lamp base of a low-pressure mercury vapour discharge lamp is indicated by the numeral 1. The inner wall of this lamp is coated with a layer of luminescent material, for example calcium halophosphate activated by manganese and antimony. This layer is indicated by the numeral 2. In the space between the opposed facing ends 3 and 4 of the lamp common or single lamp base 5 is disposed which is provided with four contact pins, indicated by the numeral 6. At the top the lamp base is covered with a cover cap 7.

In FIG. 2 the ends of a curved lamp vessel of a discharge lamp are indicated by the numerals 10 and 11 respectively. A common lamp base 12 of an electrically non-conducting material is disposed between these ends. The lamp base 12 is provided with tubular contact pins, two of which are identified with numerals 13 and 14. Disposed in the contact pins there are electrically conducting filament extension rods 15 and 16, which are respectively mechanically and electrically connected at right angles to the feedthrough wires 17 and 18 at points 19 and 20; these connections may be accomplished for example, by welding. These connections are located clear of the axial extremities of the lamp base which engage the ends 11 and 12, near the centre line 21 of the lamp vessel. This lamp base construction is also provided with a hollow cover cap 22, also of electrically non-conducting material. This cover cap is connected to the lamp base 12 by means of, for example, a screw-thread, cement or snap connection.

What is claimed is:

1. A low-pressure gas discharge lamp provided with an elongated curved lamp vessel having first and second ends disposed in opposed spaced relationship, an ionizable medium disposed in said vessel, each of said ends of said lamp vessel each including a feedthrough wire extending through said end, and a lamp base accommodating both of said ends, said base being manufactured of an electrically non-conducting material and engaging the axial extremities of said ends over less than half of the circumferential extent of said ends, said lamp base including first and second contact pins which extend at most from points proximate the center line of said lamp vessel in a direction generally perpendicular to and away from the center line of said lamp vessel, said lamp further including electrically conducting filament extension pieces, each of said extension pieces being connected at right angles to one of said feedthrough wires near the center line of the lamp vessel outside the lamp base to the corresponding feedthrough wires, each of said filament extension pieces engaging one of said contact pins, said first and second contact pins being cylindrical and one of said extension pieces being disposed within each of said contact pins, said apparatus further including a cover cap extending about the circumferential extent of said ends of said lamp vessel not covered by said base.

* * * * *